US007908875B2

(12) United States Patent
Smith

(10) Patent No.: US 7,908,875 B2
(45) Date of Patent: Mar. 22, 2011

(54) MONITORING SYSTEM

(76) Inventor: Seth Smith, La Quinta, CA (US)

( * ) Notice: Subject to any disclaimer, the term of this patent is extended or adjusted under 35 U.S.C. 154(b) by 323 days.

(21) Appl. No.: 12/158,284

(22) PCT Filed: Dec. 21, 2006

(86) PCT No.: PCT/US2006/049127

§ 371 (c)(1),
(2), (4) Date: Jun. 19, 2008

(87) PCT Pub. No.: WO2007/076060

PCT Pub. Date: Jul. 5, 2007

(65) Prior Publication Data

US 2009/0093917 A1 Apr. 9, 2009

Related U.S. Application Data

(60) Provisional application No. 60/752,943, filed on Dec. 21, 2005.

(51) Int. Cl.
*G01K 13/00* (2006.01)
*F25B 49/00* (2006.01)
*G05D 23/32* (2006.01)

(52) U.S. Cl. ..... 62/129; 62/131; 62/157

(58) Field of Classification Search ..... 62/126, 62/127, 129, 131, 157, 231
See application file for complete search history.

(56) References Cited

U.S. PATENT DOCUMENTS

2005/0235669 A1* 10/2005 Cho ..... 62/229
* cited by examiner

*Primary Examiner* — Marc E Norman
(74) *Attorney, Agent, or Firm* — The Eclipse Group LLP

(57) ABSTRACT

A monitoring system is provided that is capable of determining when the temperature of at least one point along a refrigeration unit is not within a standard temperature range known for the operation of the refrigeration unit at the at least one point. In particular, the monitoring system is capable of alerting a technician or operator if, after a predetermined amount of time has elapsed after the refrigeration unit is expected to start, the temperature of the at least one point along the refrigeration unit is not within the standard temperature range known for operation of the refrigeration unit when the compressor is running. The predetermined elapsed time may be of a length of time necessary to allow for the refrigeration unit to complete a defrost and/or delog cycle and recover from such cycle. The monitoring of the at least one point along the system may be accomplished by the monitoring of a thermocouple. Further, the monitoring system may include sensors to monitor (i) when the door of the refrigeration compartment of the refrigeration unit is, or has been, open, as well as (ii) the temperature in the refrigeration compartment. In this regard, the monitoring system may alert a technician or operator when the temperature in the refrigerator is not optimal, taking into consideration whether the door of the refrigeration compartment has been, or is, open or closed and, optionally, also taken into consideration whether the refrigeration unit is operating properly.

9 Claims, 6 Drawing Sheets

MONITORING SYSTEM

RELATED APPLICATIONS

This application claims priority to U.S. Provisional Patent Application Ser. No. 60/752,943, filed Dec. 21, 2005, titled MONITORING SYSTEM, which application is incorporated in its entirety by reference in this application.

BACKGROUND

1. Field of the Invention

This invention relates to a monitoring system, and in particular, an intelligent refrigeration monitoring system that is able to provide advanced notification and detection of potential problems occurring in a refrigeration unit.

2. Related Art

Remote monitoring systems for temperature control units, such as refrigerators and freezers are known in the art. Generally, such conventional temperature alarm systems activate an alarm when a preset temperature has been achieved. The alarm is activated even though the device may be operating correctly. For example, if the alarm system is used in connection with a refrigerator or freezer, the alarm may be triggered when the door to the refrigerator or freezer is left open long enough to cause the internal temperature in the freezer or refrigerator to drop below the preset temperature, triggering the alarm. To avoid these types of false alarms, some systems utilize time delays to allow the temperature to recover without sending an alarm notification. None of these alarm system; however, account for a drop in temperature when an alarm system is operating properly.

Other conventional alarm systems will trigger alarms upon system failure or other critical failures, or will trigger alarms after it is too late to salvage the content in the refrigeration compartment which can be very costly. A need therefore exists for a monitoring system utilizing intelligent mechanisms for monitoring temperature changes in a refrigeration unit to provide early warning to operators and/or technicians of a potential problem with the refrigeration unit.

Currently, when an alarm is triggered, the users, operator or a technician must troubleshoot the effected refrigeration product by manually observing and recording temperatures throughout the refrigeration system. Such temperature readings are usually taken through thermocouples and are used to diagnose problems. These problems can include problems with the compressor(s), leaks, restrictions and other refrigeration concerns. A need further exists for a monitoring system capable of providing temperature information, similar to the information provided through the use of thermocouples, that enables technicians to perform remote diagnostics on refrigeration units when an alarm is triggered.

SUMMARY

A monitoring system is provided that is capable of determining when the temperature of at least one point along a refrigeration unit is not within a standard temperature range known for the operation of the refrigeration unit at the at least one point. In particular, the monitoring system is capable of alerting a technician or operator if, after a predetermined amount of time has elapsed after the refrigeration unit is expected to start, the temperature of the at least one point along the refrigeration unit is not within the standard temperature range known for operation of the refrigeration unit when the compressor(s) is running. The predetermined elapsed time may be of a length of time necessary to allow for the refrigeration unit to complete a defrost and/or delog cycle and recover from such cycle.

The monitoring system may utilize sensors, including but, not limited to thermocouples, to monitor the temperature of the at least one point along the refrigeration unit. Further, more than one sensor may be utilized to monitor the temperature along the refrigeration unit. In systems where thermocouples are manufactured as part of the refrigeration unit, the thermocouples may be utilized as the temperature sensors. Further, all thermocouples on such a system may be monitored to assist a technician or operator with determining whether a system is operating within defined parameters.

Further, the monitoring system may include sensors to monitor (i) when the door of the refrigeration compartment of the refrigeration unit is, or has been, open, as well as (ii) the temperature in the refrigeration compartment. In this regard, the monitoring system may alert a technician or operator when the temperature in the refrigerator is not optimal, taking into consideration whether the door of the refrigeration compartment has been, or is, open or closed and may, optionally, also taken into consideration whether the refrigeration unit is operating properly.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. In the figures, like reference numerals designate corresponding parts throughout the different views.

DETAILED DESCRIPTION

Figure 1:
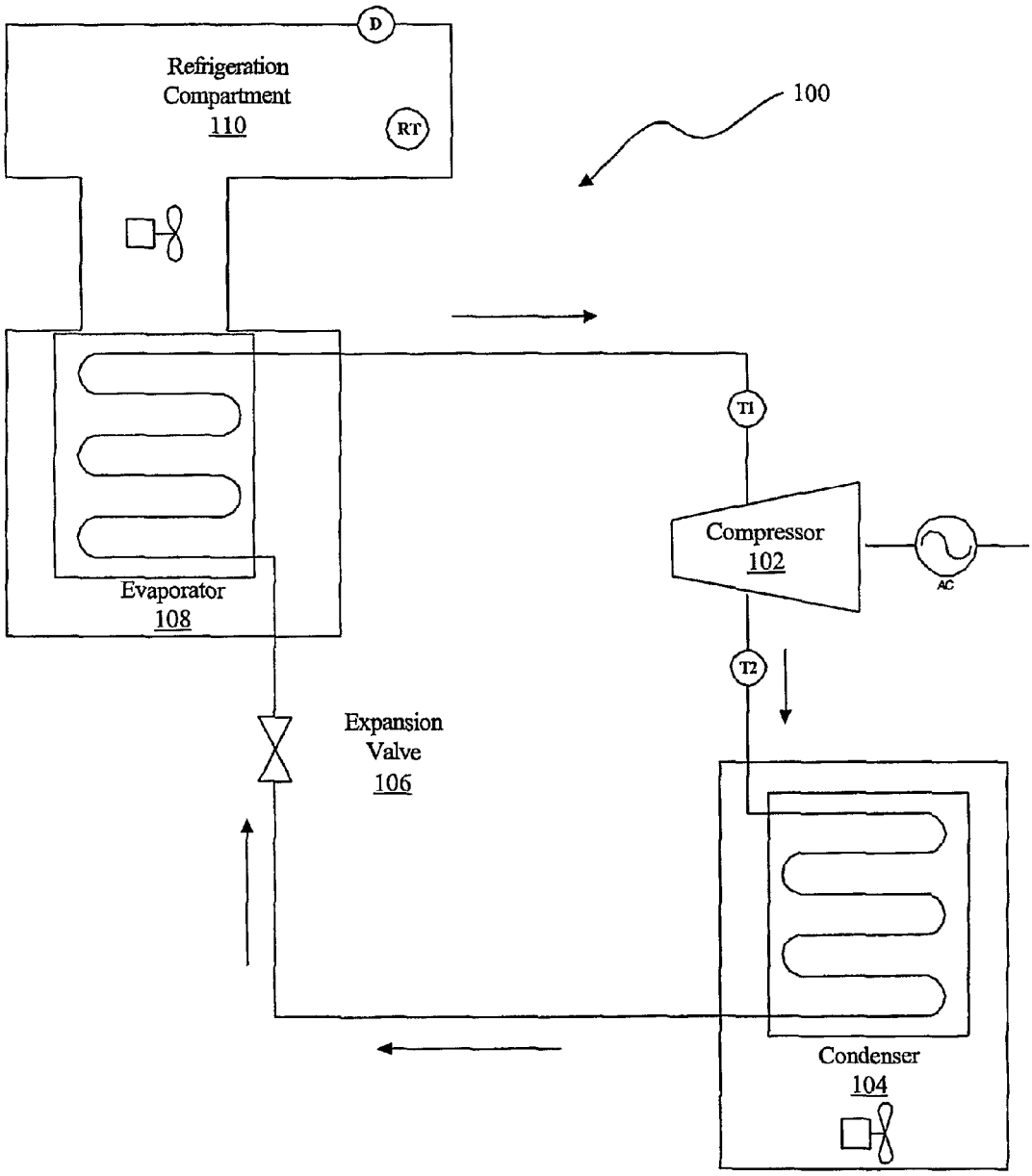
FIG. 1 is a schematic of a refrigeration unit with sensors installed to monitor and diagnosis the operation of a refrigeration unit.

Turning first to FIG. 1, FIG. 1 is a schematic of a representative refrigeration unit 100 with sensors installed to monitor and diagnosis the operation of the refrigeration unit 100. The illustrated refrigeration unit 100 is constructed of conventional components typically found in a refrigeration unit 100. As described in this application, a refrigeration unit 100 is any device utilized to reduce the temperature within a closed environment. As such, the monitoring system of the invention may be used in connection with refrigeration equipment (controlling temperatures of +4° C., or warmer to −200° C. or colder, such as refrigerator and/or freezer units), incubators, ovens, heat pumps, furnaces, automotive/residential/commercial air conditioners and other containment mechanisms capable of controlling temperature.

Refrigeration unit 100 operates by transferring heat from a lower temperature region to a higher temperature region. Refrigeration units generally operate using vapor-compression cycles. An ideal vapor-compression cycle uses refrigerant as a working fluid to absorb and reject heat energy. The energy transfer allows the vapor-compression cycle to reduce or cool a closed environment. Refrigerant is the media used to absorb and reject heat energy. Chlorofluorocarbons (CFCs), ammonia, propane, ethane, ethylene, carbon dioxide, air and water are just some of the examples of refrigerants used in refrigeration unit 100. Due to environmental concerns, more recently, the use of chlorofluorocarbons is being replaced with hydrocarbons, such as cyclopentane.

In a vapor-compression cycle, refrigerant enters a compressor 102 in the direction of the arrows in FIG. 1. As the refrigerant is compressed, it increases in temperature and pressure. After the compressor 102, the refrigerant passes through the condenser 104. Heat energy is exchanged with the surrounding environment causing the refrigerant to cool. Next, the refrigerant passes through an expansion valve 106 causing the temperature and pressure to decrease. Because of the reduction in temperature and pressure, as the refrigerant passes through the evaporator 108, it absorbs heat energy from the refrigeration compartment 110, or environment that it is trying to cool. The refrigerant exits the evaporator 110 and returns to the compressor 102 to begin the process again.

Although not illustrated, a refrigeration unit 100 of the type illustrated in FIG. 1 also may include a defroster coil that is used to heat the evaporator 110 and remove any build up of ice. In certain systems, this defrosting cycle takes place on a regular basis. In other systems, the defrosting cycle may occur as needed or at different intervals. In any event, when in the defrosting cycle, the compressor 102 shuts off and the refrigeration platform becomes dormant until the defrosting cycle is complete, at which time the system recovers and commences the refrigeration cycle. Depending again upon the manufacturer, the length of the defrost cycle may vary. For example, in certain circumstances, the length of the defrost cycle may last four (4) minutes. Those skilled in the art will recognize that other methods for defrosting refrigeration units, such as a hot-gas bypass, may be utilized in the defrost cycle to defrost a refrigeration unit and is not limited to the above described method for defrosting a refrigeration unit. Further, those skilled it the art will also recognize that certain refrigeration unit, similar to the type illustrated in FIG. 1, may include a delog cycle that should also be taken into account when calculating a time interval for comparing measurements. For purposes of this application, defrost and delog cycles shall be referred to as "automatic dormant cycles."

To provide alarms and alert technicians and operators of potential problems with a refrigeration unit, sensors may be installed at various points along the system to monitor and record certain activities occurring in the refrigeration unit. When the activities falls outside of normal ranges, as will be further described in connection with FIGS. 4-5 below, a technician or operator may be notified in advance of the problem reaching a critical stage.

In this example, sensors may be installed in the refrigeration compartment to monitor the temperature in the refrigeration compartment. Such a sensor is represented in FIG. 1 as sensor RT, which indicates that the sensor is responsible for monitoring the refrigeration compartment temperature. Also illustrated in the refrigeration compartment is sensor D, which may monitor the opening and closing of a door to the refrigeration compartment. Sensor D may not only monitor when the door is open, but for how long the door remains open and when the door is closed. While sensors RT and D are described as being used to monitor specific controls, those skilled in the art will recognize the sensors RT and D may be utilized to monitor different aspects of the refrigeration unit, may be used for an isolated purpose or may be combined with other sensors or used as part of or in connection with highly sophisticated sensor system. Further, not all of the sensors D, RT, T1 and T2 and the functions performed by such sensors are necessary for inclusion in a refrigeration monitoring system to be within the scope of the invention.

Similarly, further sensors T1 and T2 may be utilized along the refrigeration platform to monitor the temperature of the line carrying refrigerant at varying points. While the illustrated example only shows the use of the two sensors T1 and T2, those skilled in the art will recognize that it may only be necessary to utilize one sensor to monitor temperature changes along the refrigeration unit. Similarly, sensors may also be utilized along the system in addition to sensors T1 and T2. Further, while the illustrated example, shows the placement of the sensors T1 and T2 on each side of the compressor 101 respectively, as will be explained further below, in connection with FIGS. 4-5, the sensors T1 and T2 may be placed at any location along the refrigeration platform and are not limited to placement on each side of the compressor 101.

The sensors D, RT, T1 and T2 are well known in the art and are conventional and readily available commercially. As such, any type of sensor capable of monitoring the desired parameter may be utilized. Further, the sensors D, RT, T1 and T2 may provide either analog or digital outputs. For processing purposes, as will be further explained below, the output may need to be converted for processing utilizing an analog/digital converter.

Figure 2:
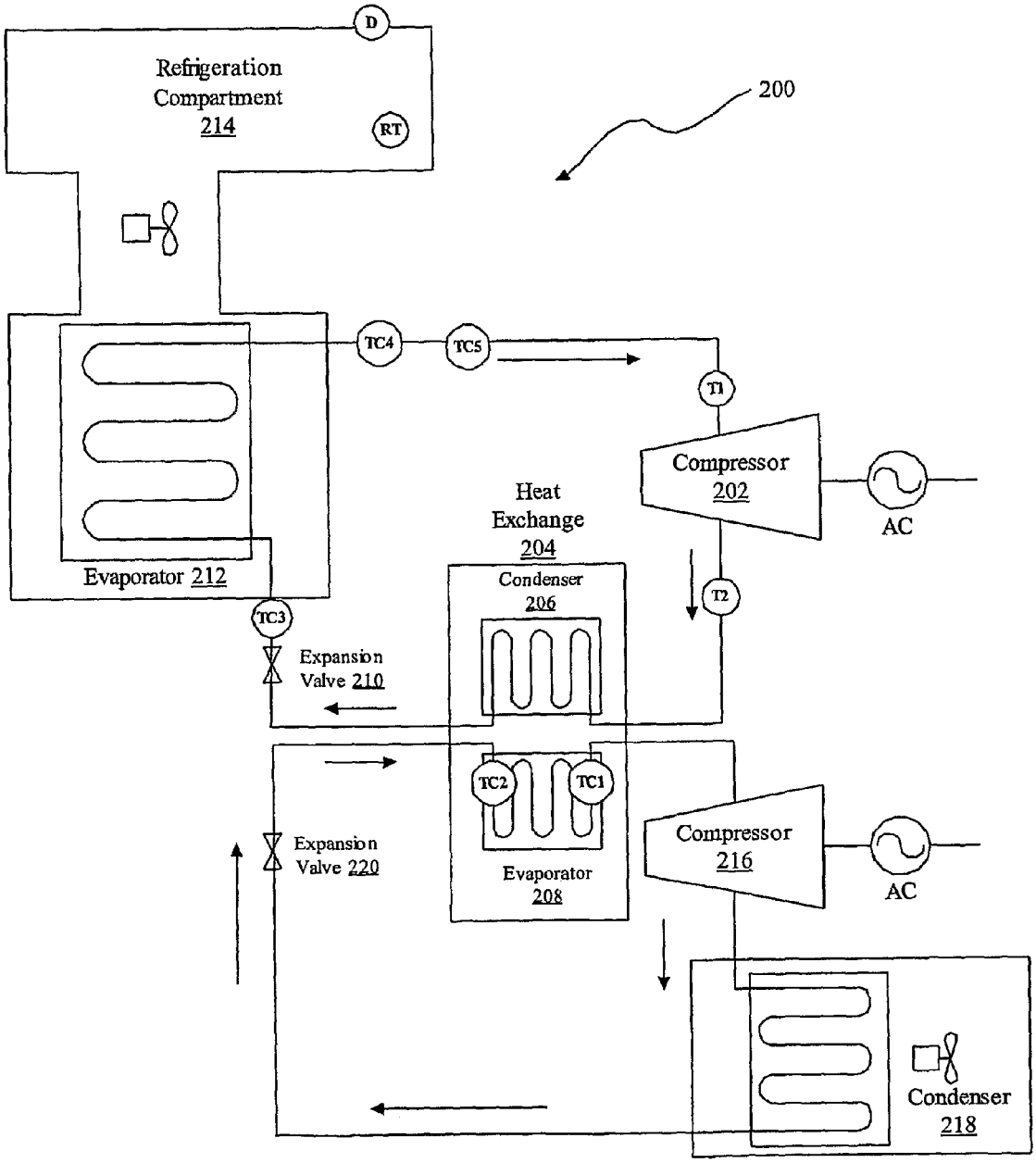
FIG. 2 is a schematic of a cascade refrigeration unit with sensors installed to monitor and diagnosis the operation of a refrigeration unit.

FIG. 2 is a schematic of a representative cascade refrigeration unit 200 with sensors installed to monitor and diagnosis the operation of the refrigeration unit. As illustrated in FIG. 2, cascade refrigeration unit 200, as well as absorption refrigeration systems, are typically used for refrigeration applications requiring ultra-low temperature storage. Cascade refrigeration unit 200 incorporates two or more refrigeration cycles in series to acquire low temperatures that cannot be achieved with a single refrigeration cycle, as illustrated in FIG. 1.

In a cascade refrigeration unit 200, refrigerant enters the compressor 202. As the refrigerant is compressed, it increases in temperature and pressure. After the compressor 202, heat energy is exchanged in the heat exchanger 204 causing the refrigerant to cool. In the heat exchanger 204, the heat energy rejected by the first condenser 206 is absorbed by the second systems evaporator 208 located in the heat exchanger. The refrigerant from the first condenser 206 then passes through a first expansion valve 210 causing the temperature and pressure to further decrease. Because of the reduction in temperature and pressure, as the refrigerant passes through the evaporator 212, the refrigerant absorbs heat energy from the refrigeration compartment 214, or environment that it is trying to cool. The refrigerant exits the evaporator 212 and returns to the first compressor 202 to begin the process again.

Simultaneously, in general terms, heat energy emitted from the first systems condenser 206 is absorbed by the second systems evaporator 208. The refrigerant then passes through a second compressor 216, located in the second system, which increases the temperature and pressure of the refrigerant. The refrigerant then passes through the second condenser 218 giving off heat energy causing the refrigerant to cool. Then, the refrigerant is passed though a second expansion valve 220, which causes the refrigerant to decrease in temperature and pressure. Once cooled in the second system, the refrigerant then passes through the second systems evaporator 208 again absorbing heat from the refrigerant flowing through the first systems condenser 206. The refrigerant then exits the second systems evaporator 208 and returns to the second compressor 216 to begin the process over again. In summary, the cascade refrigeration unit operates the same as a regular refrigeration unit except for the second stage of operation.

Although a cascade refrigeration unit of the type illustrated in FIG. 2 does not generally include a defrost cycle, a cascade refrigeration unit may periodically shut off to help maintain the system. Such a cycle in a cascade refrigeration unit is known as a "delog" cycle. During the delog cycle, both compressors shut off. In certain systems, the delog cycle takes place on a regular basis, for example every eight hours. In other systems, the delog cycle may occur at different intervals, depending upon the settings utilized by the refrigeration unit manufacturer. In any event, when in the delog cycle, the compressors 202 and 216 shut off and the refrigeration platform becomes dormant until the delog cycle is complete, at which time the system recovers and commences the refrigeration cycle. Depending again upon the manufacturer, the length of the delog cycle may vary. For example, in certain circumstances, the length of the delog cycle may last ten (10) minutes.

Additionally, as illustrated by the designation TC1, TC2, TC3, TC4 and TC5, certain cascade refrigeration units may include manufacturer installed thermocouples that may be utilized to monitor the operation of the system. A thermocouple is a temperature sensor consisting of the junction of two dissimilar metals. The output voltage produced is a function of the difference in the temperature between the hot and cold junction. In this example, five thermocouples are utilized; however, depending again upon the manufacture, a different number of thermocouples may be included with the manufacturer. Further, such thermocouples may be located at different locations on the refrigeration unit than illustrated by FIG. 2.

In addition to, or in place of, the thermocouple, temperature sensors may be installed at various points along the system to monitor and record certain activities occurring in the refrigeration unit. Similar to the sensors illustrated in FIG. 1, these additional sensors may be placed at various points throughout the system to provide alarms and alert technicians and operators of potential problems with the refrigeration unit. When the activity falls outside of normal ranges, as will be further described in connection with FIGS. 4-5 below, a technician or operator may be notified in advance of the problem reaching a critical stage.

Similar to the refrigeration unit illustrated in FIG. 1, in this example, in the refrigeration unit illustrated in FIG. 2, sensor RT may be installed in the refrigeration compartment to monitor the temperature in the refrigeration compartment. Also illustrated in the refrigeration compartment is sensor D, which may monitor the opening and closing of a door to the refrigeration compartment. Sensor D may not only monitor when the door is open, but may also record how long the door remains open and when the door is closed. While sensors RT and D are described as being used to monitor specific controls, those skilled in the art will appreciate that sensors RT and D may be utilized to monitor different aspects of the refrigeration unit, may be used for an isolated purpose or may be combined with other sensors and/or used as part of, or in connection with, highly sophisticated sensor system capable of monitoring more than one aspect of the refrigeration unit 200.

Similarly, further sensors T1 and T2 may be utilized along the refrigeration platform to monitor the temperature of the line carrying refrigerant at varying points. In this example, it may only be necessary to utilize T1 and T2 sensors in cascade refrigeration units that do not incorporate thermocouples or where it is not feasible to access the thermocouples. Since thermocouples monitor temperature, one or more of the thermocouples in a cascade system may be utilized to monitor temperature along the refrigeration unit, instead of utilizing sensors T1 and/or T2. Further, while the illustrated example only shows the use of two sensors T1 and T2, those skilled in the art will recognize that only one sensor may be utilized. However, in certain circumstances and application, it may be desirable to utilize two or more sensors. Further, while the illustrated example, shows the placement of the sensors T1 and T2 on each side of the compressor 101 respectively, as will be explained further below, in connection with FIGS. 4-5, the sensors T1 and T2 may be placed in a variety of locations along the refrigeration platform and are not limited to placement on each side of the compressor 101. Further, not all of the sensors D, RT, T1 and T2 and the functions performed by such sensors are necessary for inclusion in a monitoring system to be within the scope of the invention.

As previously described, sensors D, RT, T1 and T2 are well known in the art and are conventional and readily available commercially. As such, any type of sensor capable of monitoring the desired parameter may be utilized. Further, the sensors D, RT, T1 and T2 may provide either analog or digital outputs. For processing purposes, as will be further explained below, the output may need to be converted by an analog/digital converter for processing.

Figure 3:
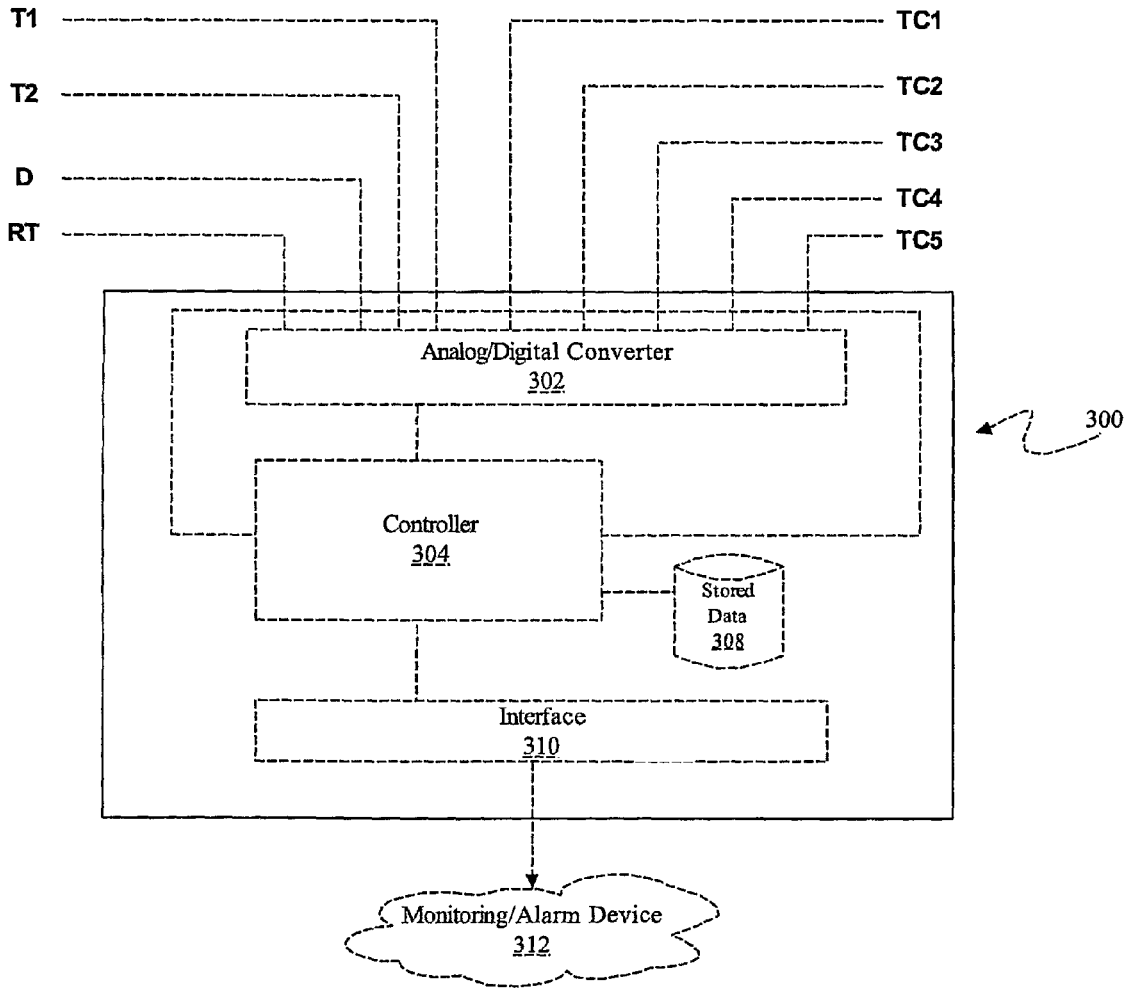
FIG. 3 is a schematic diagram of the hardware components utilized in the monitoring and diagnosis of a refrigeration unit.

FIG. 3 is a schematic diagram of the hardware components utilized in a monitoring system 300 for monitoring and diagnosing a refrigeration unit 100, 200 (See FIGS. 1 & 2). The hardware for such a monitoring system 300 may be assembled together in a single system, or may be divided into more than one system, capable of communicating with one another through known communication techniques, such as via a wired or wireless network or directly via serial or parallel ports, to name only a few example communication techniques.

The monitoring system 300 is in communication with at least a portion of the various sensors RT, D, T1, T2, TC1, TC2, TC3, TC4 and TC5 that may be located on the refrigeration unit 100, 200. The monitoring system 300 is then able to receive information from the sensors RT, D, T1, T2, TC1, TC2, TC3, TC4 and TC5 and utilize such received information to monitor the operation of the refrigeration unit 100, 200. Signals from the sensors RT, D, T1, T2, TC1, TC2, TC3, TC4 and TC5 that are not already in digital form may be first converted to digital form by an analog-to-digital converter 302 for processing. A controller 304 may repeatedly read the sensor signals, reformat them and make them available as digital data. The controller 304 may be a standard commercially available processor or controller unit that may be hardwired or programmable using optional software. Those skilled in the art will recognize that the sensor data may be transferred to the monitoring system 300 using protocols of varying detail, as necessary to meet the installation requirements for a given refrigeration unit 100, 200 and monitoring system 300.

The controller 304 may include a combination of a microprocessor, processor, or a programmable device, or a hardwired device and local storage, such as RAM/ROM or other types of memory, and may optionally include permanent data storage capabilities 308 in which received data can be stored in selected files. It is appreciated by those skilled in the art that the controller 304 may be optionally an integrated system on a chip ("SOC") integrated circuit or may be a combination of discrete sub-modules having a processor on one sub-module and memory storage on another sub-module. A variety of suitable permanent storage options are commercially available, some which combine small size and low power consumption with high reliability and high capacity. The controller 304 can also communicate through an interface(s) 310 to local or remote communication devices, which may include monitoring/alarm devices 312, through known communication techniques, including but not limited to, over a wired or wireless network connection, that may provide communication to another system, such as a computer, server, personal digital assistant, telephones, including but not limited to cellular telephones, or any other similar devices or systems, including, but not limited to, handheld devices and electronic storage devices, all of which may accessible directly, or through wired or wireless networks, including but not limited to the Internet, all of which may serve as a monitoring/claim device 312.

Figure 4:
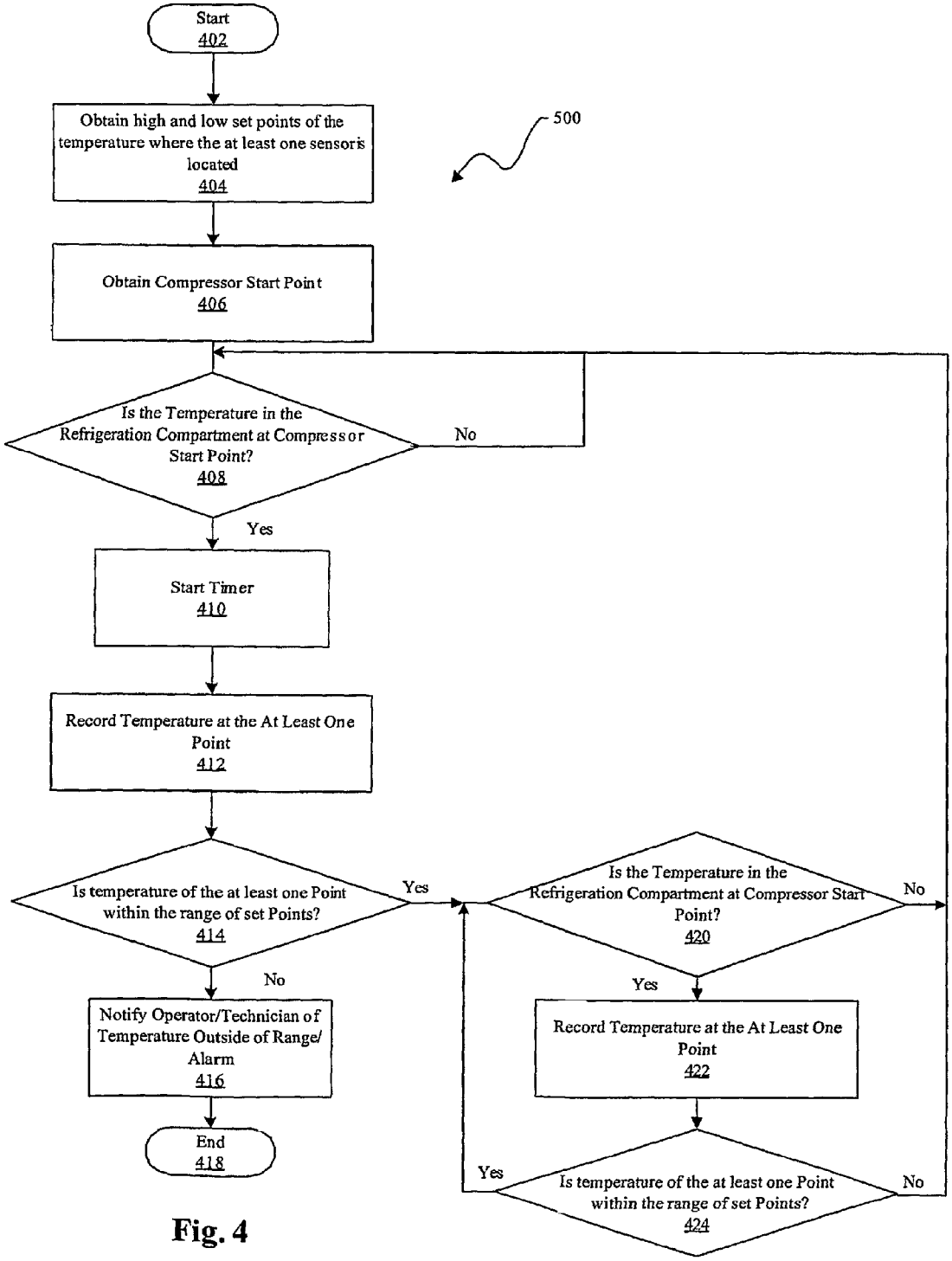
FIG. 4 is a flow diagram of an example of an implementation of a method for monitoring a refrigeration unit.
Figure 5:
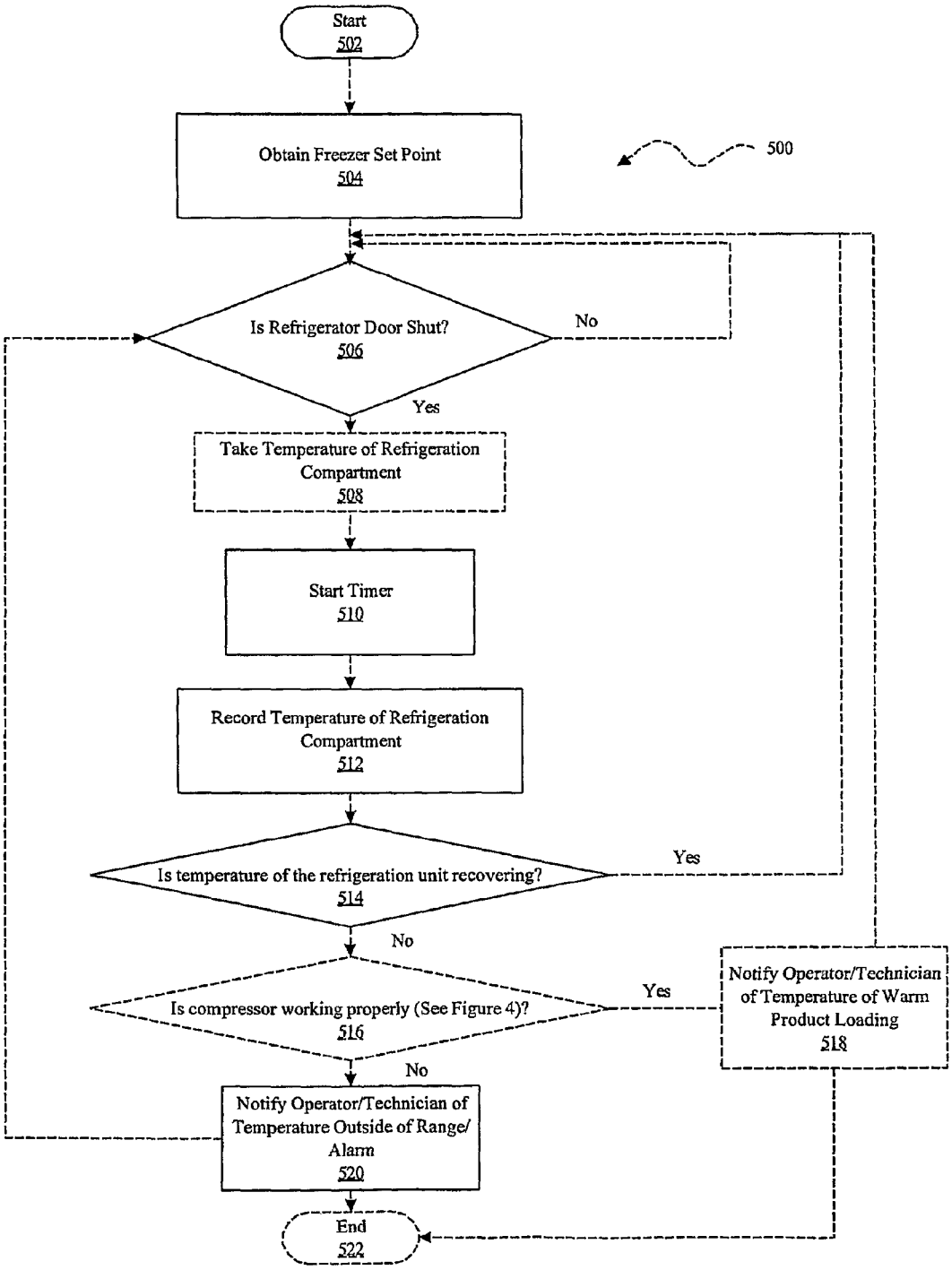
FIG. 5 is a flow diagram of another example of an implementation of a method for monitoring a refrigeration unit.
Figure 6:
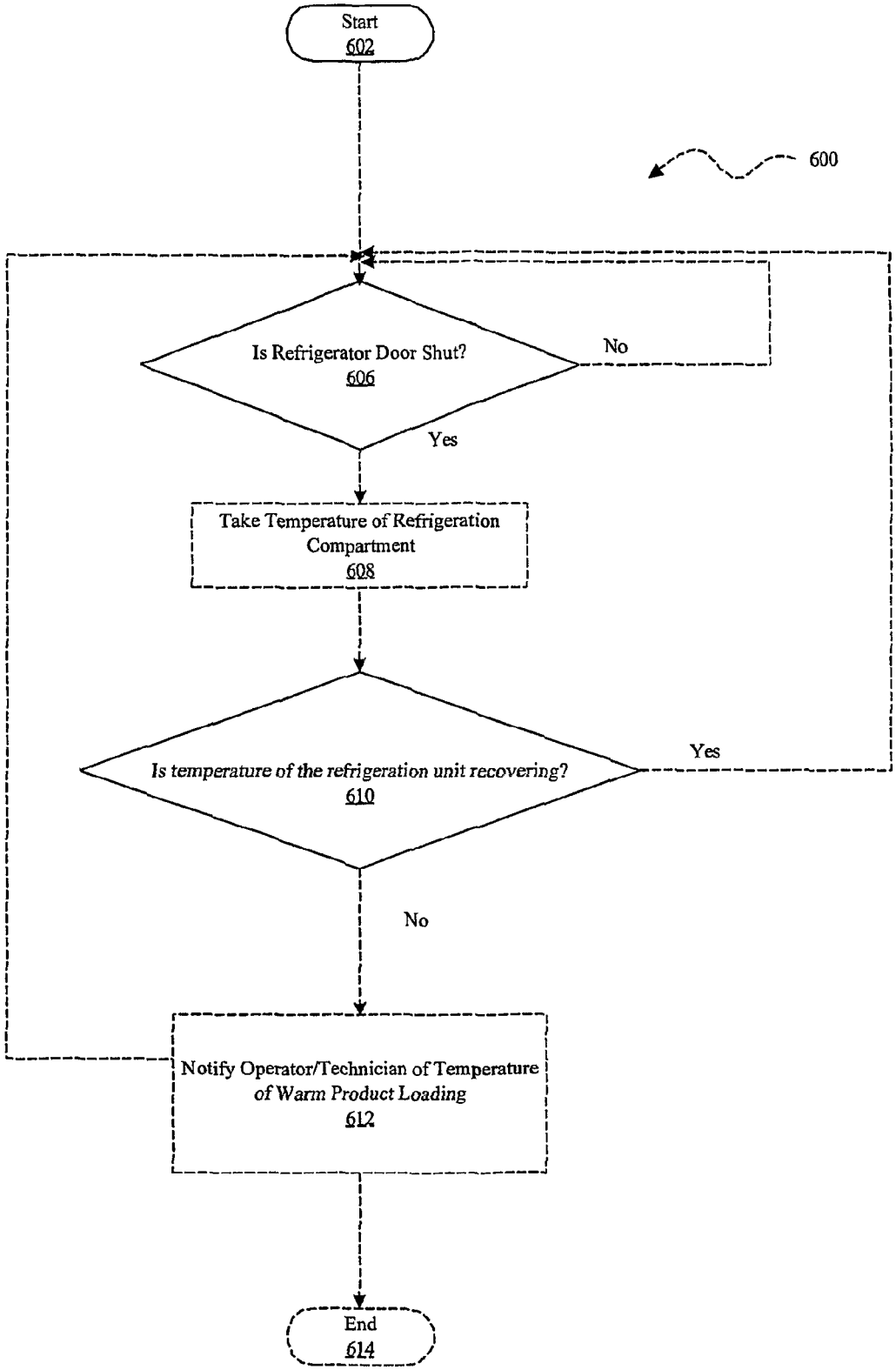
FIG. 6 is a flow diagram of yet another example of an implementation of a method for monitoring a refrigeration unit.

FIGS. 4-6 illustrate various examples of how the information received from the various sensors RT, D, T1, T2, TC1, TC2, TC3, TC4 and TC5 may be utilized to alert a technician or operator of a refrigeration unit 100, 200 (See FIGS. 1 & 2) of the possibility of operating problems or the possible failure of the refrigeration unit 100, 200. By utilizing all or a portion of the above sensors, for example, RT, D, T1, T2, TC1, TC2, TC3, TC4 and TC5, and/or any combination thereof, the monitoring system 300 (See FIG. 3) may be capable of providing advance warning of unit failures or potential problems with the operation of a unit, including both user operation and/or hardware operation problems. For example, the monitoring system 300 may monitor the opening and closing of the door on the refrigeration compartment, as well as, monitor and control the interior temperature of the refrigeration compartment and temperatures along refrigeration lines of the unit 100, 200. When thermocouples are present, the monitoring system may also be able to provide full time monitoring and recording of temperatures recorded by thermocouples, in addition to, or in place of other temperature sensors, or other similar diagnostic tools to allow technicians to perform remote diagnostics on monitored refrigeration units 100, 200. When thermocouples are not present, other sensors, such as T1 and T2, may be placed on the refrigeration unit, for example, before and after the compressor, to monitor the operation of the unit and to determine whether it is operating within normal temperature parameters.

For diagnostics, all or a portion of the information obtained by all or a portion of the sensors, for example RT, D, T1, T2, TC1, TC2, TC3, TC4 and TC5, on the refrigeration unit 100, 200 may be stored by the monitoring system 300, such that the information may be reviewed by a technician or operator. Such information may be retrieved or viewed locally utilizing a user interface device, or may be downloaded or transmitted to a remote location for review, process and/or storage. As will be further described below, the monitoring system 300 may also be capable of processing the information received from the sensors for the purpose of alerting an operator or technician of a possible system failure in advance of a critical failure that may damage the system or cause loss of stored product.

To perform diagnostics on the refrigeration unit 100, 200 utilizing information obtained from all or a portion of the various sensors, for example, RT, D, T1, T2, TC1, TC2, TC3, TC4 and TC5, certain information should first be established regarding the standard operating parameters of a given refrigeration unit 100, 200. Depending upon the manufacturer of the refrigeration unit 100, 200, such information may be published as part of the specification for the refrigeration unit 100, 200 or may otherwise be made available. In other circumstances, such parameters may need to be established by testing the system or by setting the parameters within acceptable known ranges.

A. Sensors RT & D

With respect to the sensors RT and D, these sensors may be utilized to trigger an alarm when the interior of the refrigeration compartment reaches a predetermined temperature without the door being opened for an extended period of time. Many systems will trigger an alarm when the interior of a compartment heats to a certain temperature without regard to the opening of the door or the time the door has been open. Many false alarms are therefore triggered because the alarm system does not take into account the door being opened or ajar or the time it takes to recover when the refrigerator has been loaded with warm product.

To determine when to trigger an alarm that will alert an operator or technician of an irregular temperature within the refrigeration unit, the monitoring system records a temperature set point, (i.e. freezer set point). The temperature set point is the temperature the freezer is designed to maintain, e.g., −80° C., −40° C., etc. This temperature may be set by the technician or operator based upon a desired temperature for a given application or may be programmed into the monitoring system using the manufacturer's recommended temperature.

To alert operators and technicians of potential problems with a given refrigeration unit, the monitoring system may be programmed to prevent alarm notification when the door is opened frequently. A door switch may activate a logging of the door opening and closing and the monitoring system may record the data. Once open, the door switch may log when the door closes and the interior temperature of the refrigeration unit may then be recorded. After a user definable time frame, the interior temperature may again be recorded. If the interior temperature is recovering, by moving towards the temperature set point, the alarm notification engine will not be activated. If, however, the interior temperature, after a given amount of time, is not recovering because the temperature is not moving toward the temperature set point, the monitoring system may activate an alarm.

If, the interior temperature, after a given amount of time, is not recovering because it is not moving toward the temperature set point, the monitoring system may be able to determine whether the alarm should indicate that the refrigerator has been loaded with warn product, which can affect the efficiency of the system, or indicate potential unit component failure. As explained in Section B below, the monitoring system, simultaneously with monitoring temperature recovery within the refrigeration compartment, may be monitoring the temperature of the refrigerant line taken at least one point along the refrigeration unit. If such temperature is within an acceptable range, the monitoring system will know that the refrigeration unit is working properly and the refrigeration compartment has therefore been loaded with warm product. If, however, the temperature being monitored along the line of the refrigeration unit is not within an acceptable range, it may indicate, to the monitoring system a problem with a refrigeration unit component, as opposed to warm product in the refrigeration compartment.

Further, if the interior temperature changes by a user definable amount without a door opening, the monitoring system may also activate an alarm. The monitoring system may also trigger an alarm with a user definable set point which may be activated regardless of whether the door is open or closed. This on-site alarm notification may be activated at a user definable temperature set point (warm point alarm) and correspondingly at a user definable temperature set point (cold point alarm).

Additionally, using the D sensor, the monitoring system may also be able to activate an alarm if the door is open for an extended period of time, the length of time of which may be programmed by the operator or technician or may be preset by the monitoring system. Although not necessary, this claim may be an audible alarm that will notify the user that the door is open or ajar.

Further, if the door of the compartment is being opened continuously and not allowing the temperature in the refrigeration compartment to adequately recover before the next time the door is opened, an alarm may similarly be triggered.

B. Sensors T1 & T2

When utilizing sensors T1 and T2, the monitoring system is able to determine when the temperature of at least two points along a refrigeration unit are not within a standard temperature range known for the operation of the refrigeration unit at the at least two points. Although the monitoring system is described utilizing sensors placed at two points along the refrigeration unit, it is not necessary that two sensors placed at two points be utilized. The system may be able to determine if the refrigeration unit 100, 200 is operating correctly by using only one sensor to monitor the temperature at one point along the refrigeration line. Two sensors T1 and T2 are being utilized for illustrative purposes only. Further, more than two sensors may be utilized. Additionally, although the illustrated implementation, shows the placement of the sensors along the refrigerant line before and after the compressor, those skilled in the art will recognize that the sensors may be placed at other locations along the refrigerant line.

In this example, the monitoring system 300 is capable of determining when the temperature of at least one point along a refrigeration unit is not within a standard temperature range known for the operation of the refrigeration unit at the at least one point. In particular, the monitoring system is capable of alerting a technician or operator if, after a predetermined amount of time has elapsed after the refrigeration unit is expected to start, the temperature of the at least one point along the refrigeration unit is not within the standard temperature range known for operation of the refrigeration unit when the compressor is running. The predetermined elapsed time may be of a length of time necessary to allow for the refrigeration unit to complete a defrost and/or delog cycle and recover from such cycle.

The monitoring system 300 is capable of alerting a technician or operator if, after a predetermined amount of time has elapsed, the temperature of the at least two points along the refrigeration unit is not within the standard temperature range known for operation of the refrigeration unit. The predetermined elapsed time may be of a length of time necessary to allow for the refrigeration unit to complete a defrost and/or delog cycle and recover from such cycle.

To make these determinations, the monitoring system establishes the standard temperature range for the location of each of the sensors, for example, T1 and T2, positioned along the refrigerant line when the compressor is running. For example, if one of the sensors T1 is placed along the suction line of the refrigeration unit, just before the compressor, the monitoring system will need to have, as references, the high temperature set point and the low temperature set point for the suction line. Similarly, if one of the sensors in placed along the discharge line, the monitoring system will need to have, as references, the high temperature set point and the low temperature set point for the discharge line. These temperatures can be determined by providing the monitoring system with preset manufacturer defined values or, by monitoring the system for a predetermined amount of time, for example, twenty-four hours, and setting these references to include the average range of the temperatures recorded at those points over the preset or specified period of time when the compressor is running.

Further, the monitoring system establishes the time intervals in which recordings should be taken from the sensors regarding temperature. Because refrigeration units will shut off during defrost and delog cycles, the time delay should be equivalent to the time that the refrigeration unit takes to complete a defrost or delog cycle and recover from such cycle. Again, this amount of time may be provided by the manufacture, determined by the time given by the manufacturer for the refrigeration unit to complete a delog or defrost cycle, by estimation based upon industry standards for the completion time of such cycles, or determined by monitoring the system. For example, the time intervals may be set at 12 minutes, which could account for an eight minute (8) minute delog cycle, with a four (4) minute recovery time.

Further, the monitoring system establishes at what temperature the refrigeration compartment the compressor should turn on, e.g., −77° C., −37° C., etc. Again, these temperatures can be determined by providing the monitoring system with preset manufacturer defined values, using known or estimated values based upon the operation of a given system, by setting the temperature at a point below which the compressor should turn on.

In operation, once the temperature in the refrigeration compartment reaches the temperature at which the compressor(s) should start, the monitoring system starts a timer. After a predefined period of time has elapsed, which is established by the programmed time interval (representing the time for a delog/defrost cycle plus system recovery), the temperature along the refrigeration line is taken at the established point. If the temperature reading(s), is not within the acceptable range, the monitoring system may trigger an alarm to notify the technician or operator that their may be a problem with the operation of the unit.

C. Sensors TC1, TC2, TC3, TC4 and TC5

With respect to the thermocouples TC1, TC2, TC3, TC4 and TC5, readings from thermocouples are often utilized by technicians to troubleshoot systems. To collect reading from thermocouples, technicians are required to attach equipment locally to the thermocouples. The monitoring system of the invention may maintain a constant connection with the thermocouples capable of taking readings from the thermocouples and storing the reading for diagnostics. Readings from the thermocouples can be used in addition to, or in place of, the readings from the sensor T1 and T2 described above. In other words, since thermocouples record temperature, the monitoring system may use the temperature recorded at a single thermocouple to determine whether the system is operating correctly after the preset time has elapsed from when the compressor should have started running (based upon refrigeration compartment temperature).

Is summary, the monitoring system may utilize sensors, including but, not limited to thermocouples, to monitor the temperature of the at least one point along the refrigeration unit. Further, more than one sensor may be utilized to monitor the temperature along the refrigeration unit, although it is only necessary to utilize one for the functioning of the system. Where thermocouples are manufactured as part of the refrigeration unit, the thermocouples may be utilized as temperature sensors. Further, all the thermocouples on such a system may be monitored to assist a technician or operator with determining whether a system is operating within defined parameters.

D. Establishing Reference Parameters & Alarm Triggers

When it comes to evaluating refrigeration units, it is important to know how to calculate system parameters, which may vary from system to system. The predetermined data may be found with instrumentation such as pressure gauges or thermometers, may be provided by the manufacturer of the unit, or may be determined by monitoring the system over a period of time. As described above, the system engineers may then use the data to perform calculations, by comparing real-time data with reference data, to identify potential system failures. The monitoring system may further allow technicians who install and repair refrigeration systems and who routinely measure and calculate parameters to adjust the reference points used by the monitoring system in the field.

In one example, as a freezer runs over a period of time, the average temperature of the discharge and suction lines can be established. Once these temperatures are established they can be inserted into the alarm trigger setup of a monitoring system. The following reference points may be determined, based upon the application, and may be recorded as part of an alarm trigger setup in a monitoring system that utilizes two sensors where one is located on each side of the compressor.

1) Freezer set point—The temperature the freezer is to maintain, −80° C., −40° C., etc. (Optional).
2) Compressors on—The temperature when the compressors should turn on (−77° C., −37° C., etc).
3) Discharge high set point—This is the high temperature limit of the discharge line.
4) Discharge low set point—This is the low temperature limit of the discharge line.
5) Suction high set point—This is the high temperature limit of the suction line.
6) Suction low set point—This is the low temperature limit of the suction line.
7) Time delay—This is the amount of time in minutes the suction and discharge line temperatures have to be within their high and low limits (this makes an allowance for auto defrost or delog cycles).
8) Warm product set point—This is the number of degrees the freezer should warm without a door opening to alerts the user that the freezer is operating correctly but is filled with warm product. (Optional)

Once these reference points are established, the following failures may be determined:

1) Failure if discharge and suction line temperatures are below the low set point;
2) Failure if discharge and suction line temperatures are above the high set point;
3) Failure if discharge line temperature is above the high set point and suction line is below the low set point;
4) Failure if discharge line temperature is below the low set point and suction line is above the high set point;
5) Failure if discharge line temperature is below the low set point;
6) Failure if discharge line temperature is above the high set point;
7) Failure if suction line temperature is below the low set point; and
8) Failure if suction line temperature is above the high set point.

The above reference points and failures may be applicable only to the illustrated example. As explained above, it is not necessary to utilize two temperature sensors along the refrigeration unit or to place the sensors on each side of the compressor. For example, a single sensor may be utilized, in which case the reference points may be set as follows:

1) Freezer set point—The temperature the freezer is to maintain, −80° C., −40° C., etc. (Optional);
2) Compressors on—The temperature when the compressors should turn on (−77° C., −37° C., etc);
3) High set point—This is the high temperature limit of the line;
4) Low set point—This is the low temperature limit of the line;
5) Time delay—This is the amount of time in minutes the line temperatures have to be within their high and low limits (this makes an allowance for auto defrost or delog cycles); and
6) Warm product set point—This is the number of degrees the freezer should warm without a door opening to alerts the user that the freezer is operating correctly but is filled with warm product. (Optional).

Using these set points, the following failures may be established:

1) Failure if line temperature is above the high set point; and
2) Failure if line temperature is below the low set point Further, in both above examples, it is indicated that it is optional to include the freezer set point and warm product set point. As explained above, it may only be desirable and necessary to include references for the freezer set point and warm product set points if the system provides alarms for warm product content and/or if the refrigeration compartment temperature drops below a certain temperature. The system may be designed to only monitor changes in temperature along the refrigeration line outside of normal range to indicate potential failure with unit components.

All of the data recorded by the monitoring system may be available locally or may be accessible over a network. In this manner, remote data can be used to provide information to assist in the repair of the device. Similarly, alarm triggers may be made locally or may be sent over a network to remotely alter operators or technicians. As previously described, the monitoring system may communicate to another system (or systems), such as a computer, server, personal digital assistant, telephones, including but not limited to cellular telephones, or any other similar devices or systems, including, but not limited to, handheld devices and electronic storage devices, all of which may accessible directly, or through wired or wireless networks, including but not limited to the Internet. Thus, recorded data and/or alarm triggers may be sent to, viewed by, and/or retrieved from any of the above listed devices.

E. Alarm Scenarios

FIGS. 4-6 illustrate various examples of how different alarm scenarios may be triggered utilizing the data collected by the monitoring system, as described above. Those skilled in the art will recognize that the system may be programmed to trigger alarms utilizing the recorded data in a variety of different ways and should not be limited to the examples provided below.

FIG. 4 illustrates one example of a flow diagram 400 illustrating the triggering of an alarm when a sensor, for example T1, does not measure the temperature of the refrigerant line to be within standard ranges after a time delay occurring when the compressor is to start. This method determines whether the components of the refrigeration unit, such as the compressor, are working properly. As show in FIG. 4, the method starts 402 and first obtains, as reference points, the high and low set points of the temperature where the at least one sensor is located, 404 and the compressor start point, 406. Next, the system monitors when the temperature in the refrigeration compartment reaches the compressor start point temperature 408. Once the start point temperature is reached, the system starts a timer to determine when it should take the temperature of the sensor along the refrigeration unit 410. Once enough time has elapsed, the temperature of the sensor is taken along the refrigeration unit 412. If the temperature of the sensor is within the high and low set point ranges of the temperature, then the system determines that the unit is operating within normal range, and continued monitoring will resume. If the temperature is outside of the normal range, the system will notify the operator or technician by either providing raw data for review or sending them notification that a potential problem may exist 416. At this time, the monitoring process may end, 418, until reset by a technician or operator, or may continue to monitor the unit for potential further problems. When continuing to monitor the unit, a time delay or other mechanism may need to be instituted in the process to avoid cycling of the system when the compressor runs for a long period of time. For example, if the temperatures are found within range, the system could again determine whether the temperature in the refrigeration compartment is at the compressor start point temperature 420. Since the measurement cycle was just completed and the compressor may still be running, it may not be desirable to have a time delay before recording the next temperature. In this regard, if the temperature is within the range, the temperature of the sensor along the refrigeration unit is taken again without delay 422. Until the temperature appears out of range, 424, the system will not cycle again utilizing the time delay, as illustrated at steps 408, 410, 412, 414. Further, while the process illustrates the monitoring of only one sensor, the same process may be utilized to monitor more than one sensor.

Alternatively, in certain refrigeration units, it may not be necessary to monitor the temperature in the refrigeration compartment to determine when the compressor should be working. Some refrigeration units may have the ability to know when a compressor(s) turn on. The system may then record the temperature of the sensors within a certain time after the compressor turns on, as determined by the sensor that detect the starting of the compressor. However, if the monitoring system is only triggered to record temperature when the compressor actually starts, other alarms may need to be implemented to alert when the compressor is not turning on properly based upon the refrigeration compartment temperatures.

FIG. 5 illustrates one example of a flow diagram 500 illustrating the triggering of an alarm when the temperature in the refrigeration compartment is not recovering after a door has been closed. As shown in FIG. 5, the method 500 starts 502 by obtaining, as a reference point, the freezer set point 504. Then, the system monitors when the door on the refrigeration compartment, after a period of being open, has been closed 506. Once closed, the internal temperature of the refrigeration compartment is read 508. A timer is started 510 to determine when a second internal temperature should be taken. After a predetermined amount of elapsed time, for example five (5) minutes, a second internal temperature is taken 512. Comparing the initial internal temperature and the elapsed time temperature with the freezer set point, it is determined whether the refrigerator is recovering properly after the door has been closed 514. If the temperature is moving toward the set point, the refrigerator is recovering, and the monitoring process will resume. If, however, the temperature is moving away from the set point, warming the freezer, the refrigerator is not recovering. Next, the system will check to determine whether the monitoring of the refrigeration line, as illustrated in FIG. 4, shows a problem with the operation of the components of the unit 516. If there is a problem with the operation of the unit components, it is concluded that the warming is likely due to component operation and the operator/technician is notified that the temperature of the refrigeration line is outside of range or a failure alarm Will trigger 520. If, however, there is no problem with the operation of the unit components, then the refrigeration compartment has likely been loaded with warm product. For ultra low temperature systems, loading the compartment with warm product can be very difficult on a refrigeration unit and possibly detrimental to other product contained within the refrigeration unit. Thus, if it is determined that the unit has been loaded with warm product, the system may notify an operator/technician of warm product loading 518 or alternatively of too much activity surrounding the refrigeration unit, such as too many openings and closings of the doors for the temperature to be maintained. In either case, the system may end 522 until reset or may continue to monitor the refrigeration unit for further failure.

In the example illustrated in FIG. 5, it is not necessary to check to determine if the refrigeration unit is functioning properly 516. If the temperature is not recovering properly, the monitoring system may simply notify an operator to technician of a potential problem without specifying the type of problem.

FIG. 6 illustrates one example of a flow diagram 600 illustrating the triggering of an alarm when the temperature in the refrigeration compartment is not recovering after a door has been closed, either due to warm product or because of continuous use of the unit. As shown in FIG. 6, the method 600 starts 602 by monitoring when the door on the refrigeration compartment, after a period of being open, has been closed 606. Once closed, the internal temperature of the refrigeration compartment is read 608. The temperature is then continuously monitored to determine if the refrigeration unit is recovering. If the temperature of the compartment is getting cooler, then it is determined that the refrigeration unit is recovering. If, however, the temperature is warming, then the refrigeration unit is not recovering, which may be a sign that warm product has been added to the compartment or a sign of unit failure. Alternatively, the monitoring may only include measuring to determine if the temperature of the compartment is warming, rather than recovering. In either case, if the system determines that the compartment is warming after the closing of a door, an alarm may be initiated 612. The process may end 614 until reset or may continue to monitor the refrigeration unit for further problems.

Further, although not illustrated the monitoring system could establish a warm point temperature and/or a cold point temperature that if reached by the refrigeration compartment would initiate an alarm regardless of any other unit conditions.

Those skilled in the art will recognize that many of the processes that are initiated after a time delay may be continually monitoring the operation of the system and perform certain checks at certain time intervals or initial alarms if the recording of the data appears to be unusual at a certain times or point in the refrigeration unit.

Although not illustrated, the monitoring system may also be programmed to activate an alarm upon a power outage. This alarm may be triggered by having a sensor on the refrigeration unit or on the monitoring system capable of determining when no electrical current is being received by the refrigeration unit and/or monitoring system. In this regard, the alarm could also be activated if the refrigeration unit is not plugged into a power outlet. Under these circumstances, the monitoring system should be capable of running on batteries (as a back up) or utilizing a separate power source. When the power source is shared with the refrigeration unit, lack of power to the monitoring unit would indicate that no power is being received by the refrigeration unit and an alarm could be triggered.

One skilled in the art will recognize that the monitoring system of the present invention can be implemented in hardware, software or a combination thereof. Persons skilled in the art will understand and appreciate, that one or more processes, sub-processes, or process steps described in connection with Figures may be performed by hardware and/or software. Additionally, the monitoring system may be implemented completely in software that would be executed within a processor or plurality of processor in a networked environment. Examples of a processor include but are not limited to microprocessor, general purpose processor, combination of processors, DSP, any logic or decision processing unit regardless of method of operation, instructions execution/system/apparatus/device and/or ASIC. If the process is performed by software, the software may reside in software memory (not shown) in the device used to execute the software. The software in software memory may include an ordered listing of executable instructions for implementing logical functions (i.e., "logic" that may be implemented either in digital form such as digital circuitry or source code or optical circuitry or chemical or biochemical in analog form such as analog circuitry or an analog source such an analog electrical, sound or video signal), and may selectively be embodied in any signal-bearing (such as a machine-readable and/or computer-readable) medium for use by or in connection with an instruction execution system, apparatus, or device, such as a computer-based system, processor-containing system, or other system that may selectively fetch the instructions from the instruction execution system, apparatus, or device and execute the instructions. In the context of this document, a "machine-readable medium," "computer-readable medium," and/or "signal-bearing medium" (herein known as a "signal-bearing medium") is any means that may contain, store, communicate, propagate, or transport the program for use by or in connection with the instruction execution system, apparatus, or device. The signal-bearing medium may selectively be, for example but not limited to, an electronic, magnetic, optical, electromagnetic, infrared, or semiconductor system, apparatus, device, air, water, or propagation medium. More specific examples, but nonetheless a non-exhaustive list, of computer-readable media would include the following: an electrical connection (electronic) having one or more wires; a portable computer diskette (magnetic); a RAM (electronic); a read-only memory "ROM" (electronic); an erasable programmable read-only memory (EPROM or Flash memory) (electronic); an optical fiber (optical); and a portable compact disc read-only memory "CDROM" "DVD" (optical). Note that the computer-readable medium may even be paper or another suitable medium upon which the program is printed, as the program can be electronically captured, via, for instance, optical scanning of the paper or other medium, then compiled, interpreted or otherwise processed in a suitable manner if necessary, and then stored in a computer memory. Additionally, it is appreciated by those skilled in the art that a signal-bearing medium may include carrier wave signals on propagated signals in telecommunication and/or network distributed systems. These propagated signals may be computer (i.e., machine) data signals embodied in the carrier wave signal. The computer/machine data signals may include data or software that is transported or interacts with the carrier wave signal.

It will be apparent to those of ordinary skill in the art that many more implementations are possible within the scope of this invention than those set forth above. Accordingly, the invention is not to be restricted by the described implementations but is intended to encompass any method or system (i) capable of reducing false alarms by monitoring opening and closing of door(s) of temperature control units, recording interior temperatures in connection therewith and processing such information to only trigger an alarm when the temperature does not properly readjust after the door is closed, or (ii) capable of monitoring and recording of temperatures typically recorded by thermocouples or other similar diagnostic tools to allow technicians to perform remote diagnostics on monitored temperature control units. This can be accomplished in a number of ways that will be evident by those skilled in the art in light of the various implementations offered above.

What is claimed is:

1. A monitoring system for determining when a refrigeration unit, having a refrigeration compartment, is not functioning properly, the monitoring system comprising:

an input device configured to receive reference data, where the reference data includes a temperature of a compressor start point and a standard operating temperature range of the refrigeration unit at a particular location point when the compressor is running; and a controller for reading the temperature of at least one sensor located along the refrigeration unit at such particular location point and the internal temperature of the refrigeration compartment;

the controller further configured to initiate a microcontroller to read the temperature of the at least one sensor within a predefined time period after it is determined that the temperature in the refrigeration compartment has reached the temperature of the compressor start point and further configured to determine whether the temperature of the at least one sensor falls outside the standard operating temperature range of the refrigeration unit at a such particular point.

2. The monitoring system of claim 1, where the input device is configured to receive reference data regarding the standard operating temperature range of the refrigeration unit at such multiple locations, and where the controller is further configured to read sensors located at multiple locations and configured to determine whether any of the sensors detect a temperature falling outside of the standard operating range for the location of the sensor.

3. The monitoring system of claim 1, where the controller further includes providing notification if the temperature reading of at least one sensor falls outside the standard operating temperature range.

4. The monitoring system of claim 1, where the input device is further configured to reference data including the refrigeration compartment operating temperature; and the controller is further configured to sense when the door of the refrigeration compartment has been closed, to read the internal temperature of the refrigeration unit when the door closes and at a predetermined time after the door closes, and to determine whether the temperature in the refrigeration unit is moving away from the refrigeration compartment operating temperature after such predetermined time from the door of the refrigeration compartment being closed.

5. The monitoring system of claim 4, where the controller further includes providing notification if the temperature in the refrigeration compartment is not moving toward the refrigeration compartment operating temperature after such predetermined time from the door of the refrigeration compartment being closed.

6. The monitoring system of claim 1, where the sensors are thermocouples.

7. A method for monitoring operation of a refrigeration unit having a refrigeration compartment, the method comprising the steps of:

determining the standard operating temperature range of at least one sensor located along the refrigeration unit when a compressor of the refrigeration unit is running;

determining the temperature of the refrigeration compartment at which the compressor begins to run;

setting an elapsed time for taking the temperature of at least one sensor that allows for the compressor to complete an automatic dormant cycle and recover from such cycle; and commencing measurement of the elapsed time when the temperature in the refrigeration compartment is at the temperature at which the compressor should begin to run;

taking the temperature of the at least one sensor after conclusion of the elapsed time period;

determining whether the temperature of the at least one sensor is within the standard operating temperature range; and initiating an alert if the temperature of the at least one sensor is outside of the standard operating temperature range.

8. The method of claim 7, further includes the step of monitoring the closing of a door on the refrigeration compartment and determining whether the temperature in the refrigeration compartment is moving toward a desired operating temperature after the door has been closed.

9. The method of claim 8, further include initiating an alert of the addition of warm product to the refrigeration compartment if (i) the temperature of the refrigeration compartment is not moving toward the desired operating temperature after the door has been closed for a specified period of time and (ii) the temperature of the at least one sensor is within the standard operating temperature range.

* * * * *